United States Patent [19]

Wasserfaller

[11] 4,295,349

[45] Oct. 20, 1981

[54] DOOR LOCK

[76] Inventor: Georg Wasserfaller, Gratschach, A 9523 Post Landskron, Austria

[21] Appl. No.: 3,465

[22] Filed: Jan. 15, 1979

[51] Int. Cl.[3] ..... E05B 59/00

[52] U.S. Cl. ..... 70/111; 70/150; 292/150; 292/169.18

[58] Field of Search ..... 70/111, 145, 153, 150, 70/478, 481, 482; 292/169.18, 150

[56] References Cited

U.S. PATENT DOCUMENTS

| | | | |
|---|---|---|---|
| 2,164,290 | 6/1939 | Hurd | 70/150 X |
| 2,220,591 | 11/1940 | Voight et al. | 70/481 X |
| 3,895,505 | 7/1975 | Wasserfaller | 70/111 |

FOREIGN PATENT DOCUMENTS

| | | | |
|---|---|---|---|
| 627316 | 5/1963 | Belgium | 70/150 |
| 1921037 | 11/1970 | Fed. Rep. of Germany | 70/150 |

*Primary Examiner*—William E. Lyddane

[57] ABSTRACT

A door lock comprises a latch and a mechanism for locking the latch which includes a pivotal element having at least one arm engageable with the latch to withdraw it to the open position a locking bolt depressable to move into a blocking position to prevent to swivel the pivotal element to withdraw said latch, and a key-operable unlocking lever for moving the locking bolt out of the blocking position to permit to swivel said pivotal element, the lever having a catch operable by the key.

3 Claims, 2 Drawing Figures

Figure 1:
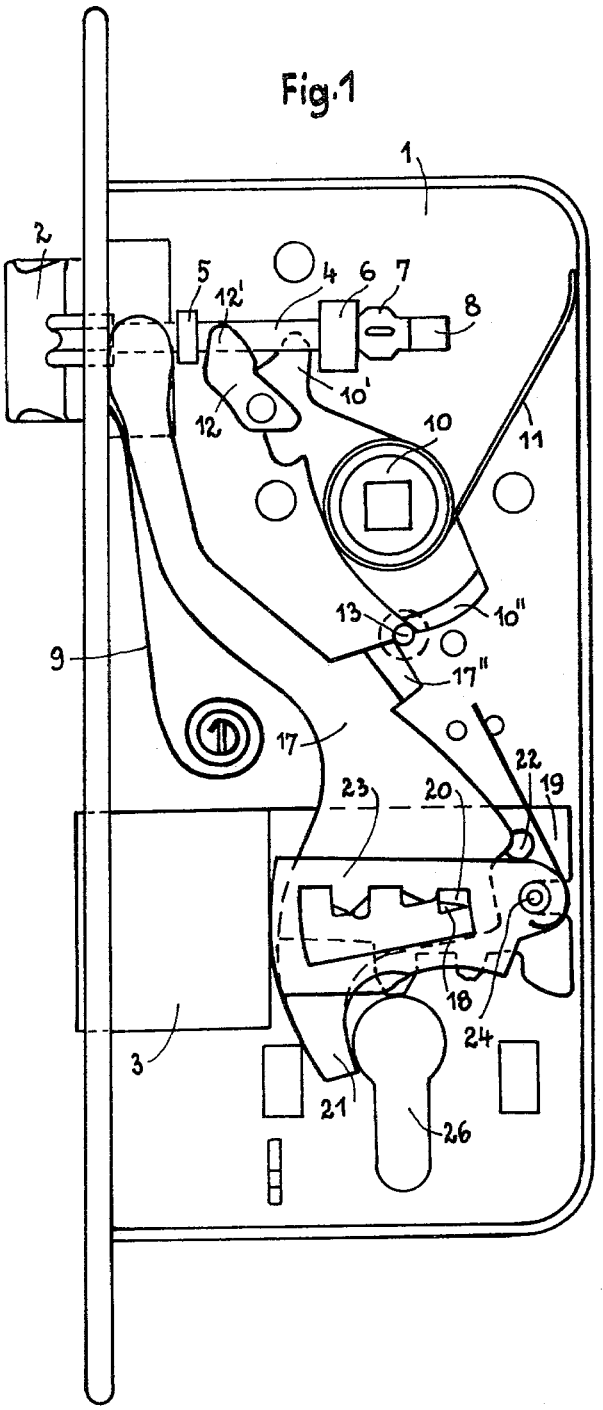

1
2
5
12'
4
6
7
8
10'
12
10
11
13
10"
9
17"
17
22
19
23
20
3
18
24
21
26

2
17'
13
15'
16
15
14
25
3

DOOR LOCK

The present invention relates to improvements in a door lock, and more particularly to a lock which comprises a latch reciprocable between an open and a locked position, and means for holding the latch against reciprocation, the latch holding means including a locking bolt depressable to engage the latch and thereby to hold the latch against reciprocation, and a key-operable unlocking lever for moving the locking bolt to disengage the latch.

Door locks of this type have been used widely for the control of installations, such as room heating or air conditioning units, which depend on the locking condition of the lock since it is very easy to provide on the inside of the door merely a latch for the lock so that a lock which has been locked by a key indicates clearly that no one is present in the locked room and, therefore, the unit may be shut off, as for instance described in Austrian Pat. No. 297,869. A control switch may be operated automatically by an operating part of the lock.

In a door lock of this type disclosed in my U.S. Pat. No. 3,895,505, dated July 22, 1975, the locking bolt is slidable into the reciprocating path of the latch so that, when the locking bolt has been depressed, the latch cannot be withdrawn into the lock housing. The lock is opened not only by withdrawing the locking bolt but also by turning the key or a nose of the lock cylinder. This causes an intermediate lever pivotally mounted on a base plate of the lock to be pivoted, and the pivoting lever engages an unlocking lever, which is also pivotally mounted, and causes the unlocking lever to pivot. This, in turn, moves an oblique free end of the unlocking lever against the depressed locking bolt and slides the same out of its locking position.

A problem arises in this known door lock when the door is slammed shut, for instance by a draft, while the locking bolt is in the depressed position. In this case, the latch is subjected to a strong impact and this force may cause damage to the bolt or other parts of the lock.

Furthermore, the intermediate lever serves in this known lock as a locking lever and is operable only when the nose of the lock cylinder is turned 180°. Therefore, when the lock bolt is withdrawn and it is desired to move the locking bolt out of engagement with the latch, the lock must first be locked and then unlocked again.

It is the primary object of this invention to improve this type of door lock by simplifying its structure, reducing the number of parts to a minimum and limiting the danger of damage to its component parts, particularly the locking bolt for the latch even when the door is slammed shut when the bolt locks the latch.

The above and other objects are accomplished in accordance with the invention in the door lock which comprises a latch reciprocal between an open and a locking position and biased into the locking position, a pivotal element having at least one arm engageable with the latch to withdraw it to the open position, a locking bolt depressable to move into a blocking position to prevent swivelling of the pivotal element to withdraw said latch and a key-operable unlocking lever for moving the locking bolt out of the blocking position to permit swivelling of said pivotal element, the unlocking lever having a catch operable by the key.

In such a door lock, the latch is free to move even when the locking bolt is depressed but a withdrawal of the latch is prevented by operation of the pressing element connected with the pivotal element. Therefore, the locking bolt is subjected only to the readily ascertainable pressure forces from the pressing element but not to the totally unpredictable forces due to slamming of the door when the bolt is in the depressed position, the latter depending also on the mass of the door to which the lock is affixed.

Furthermore, a considerable reduction of component parts is obtained with the present door lock, no intermediate actuating lever and its pivot being required and the manufacture and mounting of the lock being accordingly less costly. Since the key or nose of the lock cylinder engage the unlocking lever directly, these parts may readily be so dimensioned that a relatively small turning angle of the key or lock cylinder is sufficient to press the locking bolt out of its locking position. Preferably, as seen in the turning direction of the key or lock cylinder, the portion of the turning path bringing the key or lock cylinder nose into engagement with the unlocking lever precedes that which brings the key or lock cylinder nose into contact with the lock bolt.

Figure 2:
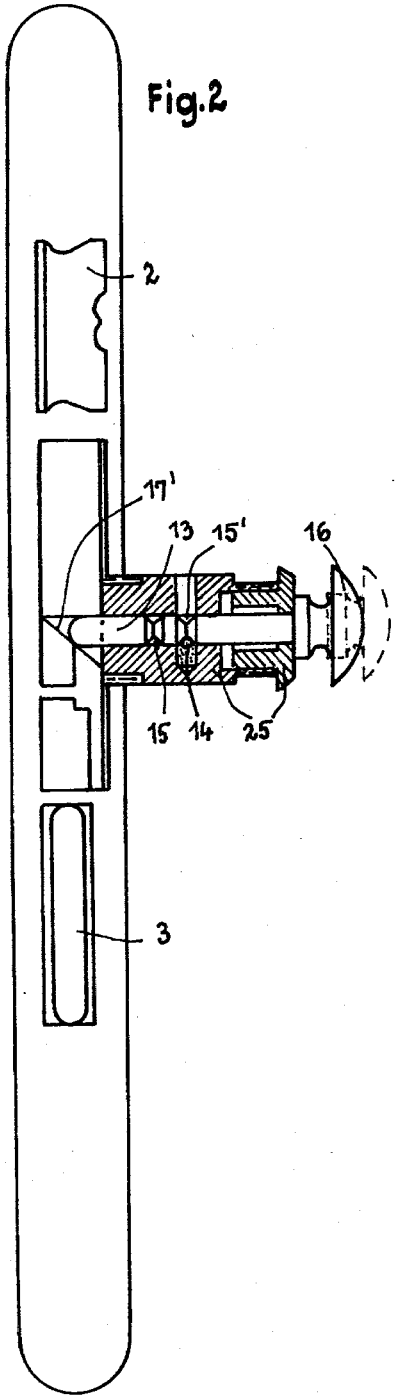

The above and other objects, advantages and features of the present invention will become more apparent from the following detailed description of a now preferred embodiment of the door lock, taken in conjunction with the accompanying drawing wherein FIG. 1 is a plan view of the door lock, with the cover plate removed to illustrate the lock mechanism, and FIG. 2 is a side view, partially in section, of the lock and illustrating a structural detail.

Referring now to the drawing, the lock mechanism is housed in a case conventionally comprised of a base plate 1 and a cover plate (not shown), the lock case being affixed to a door. Latch 2 and key-bolt 3 are mounted in the lock case.

Latch 2 is reciprocal between an open and a locked position, being biased into the outwardly projecting, locked position by spring 9. To guide the latch in its path of reciprocation, the latch has a guide bolt 4 extending into the lock case. The guide bolt of the latch slides for reciprocation in bearing sleeve 6 which may be moved into engagement with stop 7, the sleeve being movably guided in slot 8 defined in base plate 1 and a corresponding slot in the cover plate. Guide bolt 4 of latch 2 carries a collar 5.

Reciprocation of latch 2 may be effected, on the one hand, by a force directed against its oblique face or, on the other hand, by pivoting pivotal element 10 illustrated as a nut and biased by spring 11 against catch 12 rotatably mounted in the base and cover plates of the lock case. Arm 12' of catch 12 engages guide bolt 4 of the latch and first arm 10' of nut 10 engages guide bolt 4 to contact a front face of bearing sleeve 6, the latter contacting stop 7 of guide bolt 4 and thus entraining the same with latch 2 to withdraw the latch against the bias of spring 9.

Pivotal nut 10 has a second arm 10'' and locking bolt 13 is depressable to move into the pivoting path of second arm 10''. As seen in FIG. 2, locking bolt 15 has a rounded end and is movable into two positions defined by axially spaced grooves 15 and 15' cooperating with ball 14 to hold the locking bolt in a selected axial position. In one of these defined positions, the rounded end of locking bolt 13 extends into the pivoting path of second arm 10'' of pivotal element 10 (as shown in full lines in FIG. 2) and thus engages the arm, as shown in FIG. 1, while ball 14 rests in groove 15 in the other locking bolt position so as to be withdrawn from the pivoting path and enabling pivotal nut 10 to move freely.

In the illustrated embodiment, bolt 13 has button 16 to enable the guide bolt to by moved into its selected positions. This movement may also be effected by unlocking lever 17 which has a wedge-shaped portion 17' arranged to be moved into contact with the rounded end of locking bolt 13 to move the locking bolt out of the pivoting path of second arm 10''.

Unlocking lever 17 has an arm and its central portion carries wedge 17' while its free end is positioned between two stops spaced from each other on the latch, the stops being constituted in the illustrated embodiment by a rear face of latch 2 and collar 5 on latch guide bolt 4. Key-bolt 3 has extension 19 which carries pivot pin 20 passing through cutout 18 in the unlocking lever whereby the unlocking lever is pivotally mounted on the key-bolt. Lever 17 furthermore has catch 21 operable by a key (not shown) when key-bolt 3 is in the completely withdrawn position, i.e. when the lock has been opened by the key. Catch 21 of unlocking lever 17 is arranged to extend into the turning path of the key or the nose of a locking cylinder mounted in hole 26 of base plate 1. The catch has an end bent in the direction of the base plate to provide an enlarge entrainment face for the key or the nose of the lock cylinder.

The key-bolt 3 is guided for reciprocation between an open and locked position by a pin or embossment affixed to base plate 1 and engaging slot 22 in extension 19 of the key-bolt.

Pivot pin 20 cooperates with spring-biased notched holder 23 pivotal about pin 24.

The illustrated arrangement assures that the unlocking lever can be operated only when the key-bolt has been withdrawn, i.e. the lock is open, which obviates unnecessary movements of component parts of the lock and saves wear. Furthermore, unlocking lever 17 may be pivotally mounted on a existing pivot cooperating with a notched holder, which pivot may be of polygonal cross section, and this simplifies the assembly. Providing the unlocking lever with an arm whose central portion is arranged to move the locking bolt out of the pivoting path of the second pivotal element arm and whose free end is positioned between two latch stops has the advantage that operation of the key or lock cylinder will simultaneously operate the unlocking lever.

As shown in FIG. 2, locking bolt 13 is housed in casing 25 screwed into base plate 1 of the lock case on the inside of the door.

The above-described lock is operated in the following manner:

The door is securely locked when button 16 is depressed and locking bolt 13 is accordingly snapped into an axial position wherein ball 14 rests in groove 15' and the rounded end of the locking bolt blocks second arm 10'' of pivotal nut 10. The pivotal nut is rotatable by a button or pin (not shown) and this button or pin cannot be turned to enable latch 2 to be reciprocated into the withdrawn or open position when locking bolt 13 is in this axial position. However, the latch may be pushed inwardly against the bias of spring 9 by a force applied directly against the latch without any force being transmitted to locking bolt 13. Therefore, the locking bolt may also be effective when the door is open and then closed, latch 2 snapping into a latch hole in the door jamb upon closing of the door under the bias of spring 9. After the door has been closed, it cannot be opened by turning pivotal element 10 because it has been blocked by locking bolt 13.

When it is desired to open the lock, locking bolt 13 must be withdrawn into the second axial position shown in broken lines in FIG. 2, which may be accomplished by pivoting lever 17 by turning a key inserted into the lock or the nose of the lock cylinder, thus causing the wedge face 17' of the lever to engage the rounded end of locking bolt 13 and press the same outwardly.

As can be seen from FIG. 1, the key or lock cylinder can pivot unlocking lever 17 only when key-bolt 3 has been fully withdrawn from its locking position since catch 21 of the lever is close enough to the moving path of the key or lock cylinder nose only in this position of the key-bolt, this path being indicated by hole 26 in base plate 1 which carries the lock cylinder.

Pivoting of unlocking lever 17 at the same time pushes latch 2 back against the bias of spring 9 since the free end of the lever will press against collar 5 on the latch.

What is claimed is:

1. A door lock comprising (a) a latch reciprocal between an open and a locking position, the latch being biased into the locking position, (b) a pivotal element having at least one arm engageable with the latch to withdraw it to the open position, (c) a locking bolt depressable to move into a blocking position to prevent swivelling of the pivotal element to withdraw said latch, (d) a key-operable unlocking lever for moving the locking bolt out of the blocking position to permit swivelling of said pivotal element, the unlocking lever having a catch operable by the key, and (e) a key-bolt key-operable for reciprocation between an open and locked position, the unlocking lever being pivotally mounted on the key-bolt.

2. The door lock of claim 1, wherein said pivotal element is provided with a second arm and said locking bolt is depressable to move into the pivoting path of the second arm of the pivotal element.

3. The door lock for claim 2, wherein the unlocking lever has an arm having a central portion arranged to move the locking bolt out of the pivoting path upon pivoting of the lever and a free end, the latch having two stops spaced from each other and the free end of the unlocking lever arm being positioned between the two latch stops.

* * * * *